United States Patent [19]

Eriksson et al.

[11] 3,952,632

[45] Apr. 27, 1976

[54] DEVICE USED AS A POWER TRANSMISSION COMPONENT FOR ELEVATION OF A GUN BARREL

[75] Inventors: Nils Börje Eriksson; Gustav Hilmer Tidemalm, both of Karlskoga, Sweden

[73] Assignee: AB Bofors, Bofors, Sweden

[22] Filed: May 14, 1974

[21] Appl. No.: 469,711

[30] Foreign Application Priority Data

May 23, 1973 Sweden ..... 7307218

[52] U.S. Cl. ..... 92/117 R; 92/134; 92/160; 89/41 H

[51] Int. Cl.[2] ..... F01B 15/02; F01B 31/00

[58] Field of Search ..... 92/118, 119, 165, 134, 92/117, 160; 91/217 R; 89/41 H

[56] References Cited

UNITED STATES PATENTS

| | | | |
|---|---|---|---|
| 2,946,262 | 7/1960 | Bruehl | 89/37 |
| 3,049,097 | 8/1962 | Kershaw | 91/165 |
| 3,146,680 | 9/1964 | Hutter et al. | 92/117 R |
| 3,399,786 | 9/1968 | Honeycutt | 92/119 |

FOREIGN PATENTS OR APPLICATIONS

| | | | |
|---|---|---|---|
| 485,617 | 5/1938 | United Kingdom | 92/134 |

*Primary Examiner*—Paul E. Maslousky
*Attorney, Agent, or Firm*—Pollock, Vande Sande & Priddy

[57] ABSTRACT

Power transmission apparatus for controlling the elevation of a gun barrel. Two telescopic members are provided, one being secured to the gun base and the other to the gun barrel. The first and second parts define a first piston and a hollow piston rod attached thereto with the first piston being slidable in a cylinder defined by the second part. A second piston having an associated rod is also provided and such second piston is slidable inside the first piston rod. First and second chambers are thus formed, the first being filled with an incompressible fluid such as hydraulic fluid and the second chamber is filled with a highly compressible fluid such as a gas.

3 Claims, 7 Drawing Figures

DEVICE USED AS A POWER TRANSMISSION COMPONENT FOR ELEVATION OF A GUN BARREL

BACKGROUND OF THE INVENTION

The present invention relates to a device intended for use in connection with the elevation of gun barrels, and which comprises two parts arranged telescopically in relation to each other, one of the parts being fastened to the barrel and the other part being fastened to a base, for instance a mounting, for the barrel. With said device, the displacement required between the parts for the elevation and depression of the barrel is achieved by means of a first medium with low compressibility, for instance hydraulic oil.

Particularly for field artillery, when it must be possible to elevate and depress the barrel manually, there is a pronounced desire that the operation shall be easy, and that there shall be an equalization of the unbalance of the barrel due to the act that the pivot suspension of the barrel is located comparatively far to the rear on the barrel, which has hitherto required that the operating force for actuation of the barrel be dependent on the angle of elevation of the barrel.

The present invention is primarily intended to solve said problem in a technically simple way, and the feature that can mainly be considered to be characteristic for the device according to the invention is that a quantity of a second medium with high compressibility is enclosed in a space arranged between the parts which has a minimum volume when the barrel is in the depressed position and a maximum volume when the barrel has the maximum elevation, the enclosed second medium then functioning as an equalizing spring for an unbalance obtained in the barrel due to the way in which this is supported in the base.

According to the invention, said volumes are also arranged in such a way in relation to each other that, with a given quantity of second medium, an increase of pressure in the first medium is required to actuate the barrel from an elevated position to the depressed position, and a reduction of pressure in the first medium is required to actuate the barrel from the depressed position to the elevated position.

A further development of the concept of the invention involves that an outside part of the device, between a protruding flange on such outside part and a supporting surface in a fixed position in relation to the base, has a ring spring mounted therein dampens the axial movements that occur in said one part. Such axial movements are caused by recoil phenomena when firing with the barrel and are particularly noticeable at high angles of elevation.

BRIEF DESCRIPTION OF THE DRAWINGS

An embodiment proposed at present which has the characteristics significant for the invention will be described in the following, with reference to the attached drawings, in which

FIG. 4*a* is placed above FIG. 4*b*, FIG. 4*c* in a vertical view shows the device according to FIGS. 4*a*–4*b* viewed from one end, FIG. 5 in a vertical view and in cross-section shows an enlarged part comprised in the device according to FIGS. 4*a*–4*b*.

DETAILED DESCRIPTION OF THE PREFERRED EMBODIMENT

Figure 1:
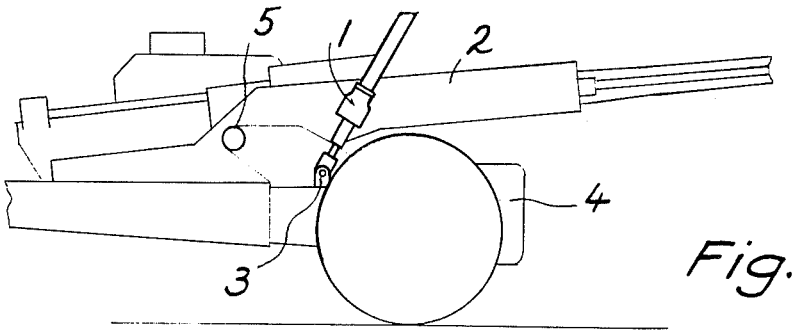
FIG. 1 is a vertical view showing the fastening, in principle, of the device in a gun where the barrel has a depressed position.
Figure 2:
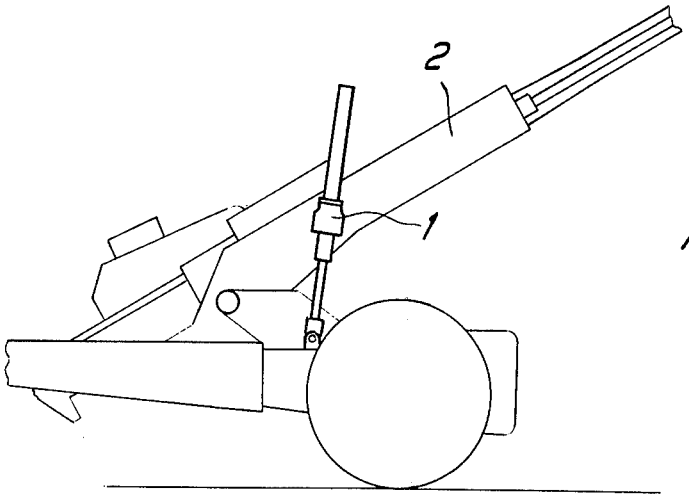
FIG. 2 in a vertical view shows the device according to FIG. 1, but where the barrel is in an elevated position.
Figure 3:
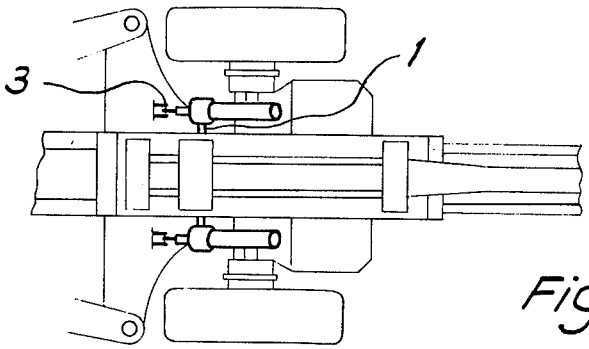
FIG. 3 in a horizontal view shows the device according to FIG. 1.

FIGS. 1–3 illustrate schematically parts of a field artillery gun which appropriately can utilize the device according to the invention. Said device is fastened in a schematically indicated first rotary suspension 1 fastened to a barrel 2, and in a likewise schematically indicated second rotary suspension 3 fastened to a mounting 4 or a corresponding part.

The barrel 2 is also suspended in the mounting in a trunnion 5, and the device according to the present invention is thus to serve as a power transmitting component in the elevation and depression of the barrel, at the same time that it equalizes the unbalance of the barrel.

Figure 4A:
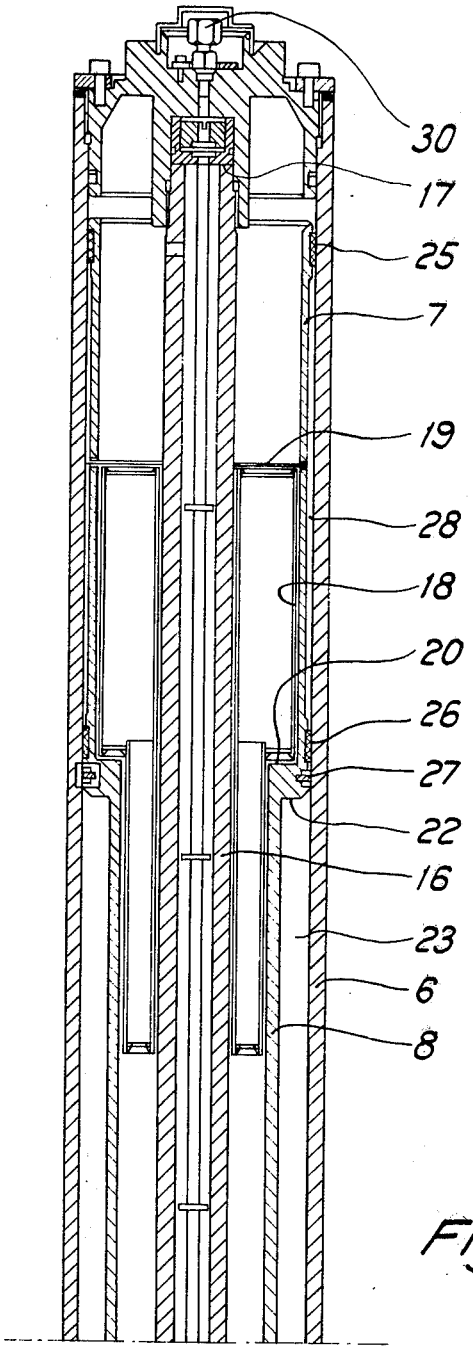
FIGS. 4*a*–4*b* in vertical views and in cross-sections together show the device when
Figure 4B:
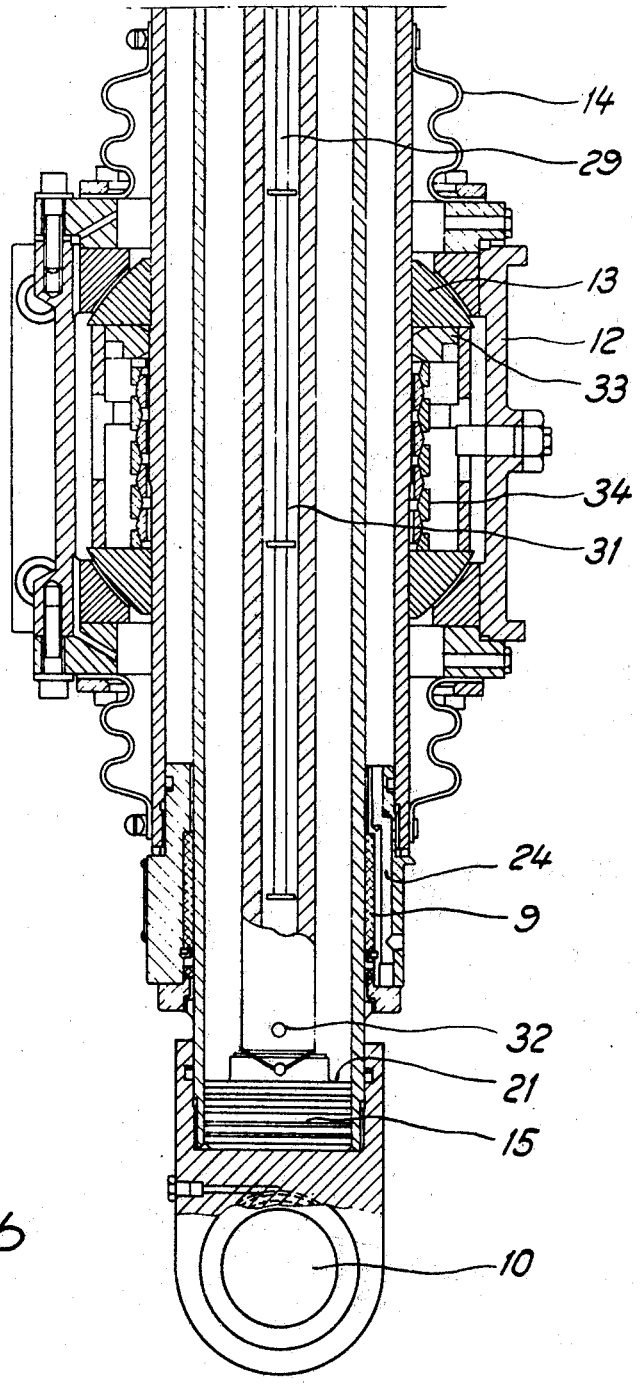
Figure 4C:
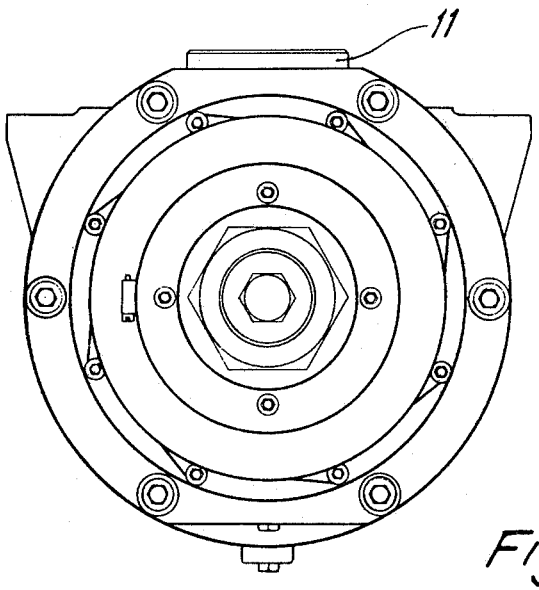

According to FIGS. 4*a*–4*b*, which appropriately should be placed one above the other, the device comprises two parts arranged telescopically in relation to each other, one of the parts then having the form of a tubular cylinder 6 and the other part having a first piston part 7 with a first piston rod 8 which is supported in the cylinder where said first piston rod is guided via the first piston part and by means of a seal 9 arranged at the lower end of the cylinder. The first piston rod 8 is supported by means of a through hole 10 in one of its ends on a journal fastened to the mounting and not shown in the figure, while said cylinder 6 on its outside supports a bearing housing 12 provided with a bearing journal 11 (see FIG. 4c). The bearing journal 11 is assumed to coact with a supporting hole arranged in the barrel and not shown in detail. The bearing housing is attached to the cylinder via a spherical bearing comprising an upper member and a lower member the higher member designated by numeral 13, which is protected from contamination by means of a rubber sleeve 14.

Said first piston part 7 and first piston rod 8 are also tubular. A second piston part 15 is supported inside the first piston rod 8, and a second piston rod 16 belonging to the second piston part extends inside the first piston rod 8 and the first piston part 7. The second piston rod is moreover fastened to the upper end surface of the cylinder 6 in the fastening device 17.

Through a special insert unit 18, parts of the first piston part 7 and the first piston rod 8 are made double-walled, and the insert unit is made so that small gaps are obtained between the unit 18 and the piston part and piston rod in question. The insert unit is secured in its position in the longitudinal direction of the device with the aid of a securing ring 19 and an actuating surface 20 inside the piston part 7.

A space with a variable volume which is intended to enclose a medium with high compressibility, for instance a gas of an appropriate kind, is limited by said upper end surface of the cylinder 6, by the inner walls of the first piston part and the first piston rod, by the outer wall of the second piston rod 16 and by the upper end surface 21 of the second piston part 15. The volume of said space is thus incresed when the telescopically arranged parts are extended and therefore the volume reaches a maximum value at the maximum extension, which corresponds to the case when the barrel has the maximum elevation, and a minimum value at a maximum compression of the parts, which corresponds to the case when the barrel is in the depressed position.

Between the inner wall of the cylinder 6, the outer wall of the piston rod 8 and the lower end surface 22 of the first piston part a further space 23 is formed, which via a channel 24 is connected with a source of pressure not shown for a medium with low compressibility, for instance hydraulic oil, which latter medium is used when achieving the elevation and depression of the barrel. The pressures in the different mediums are set against each other inasmuch as they act upon the actuating surfaces 20 and 22 located on the first piston 7. In the present case, the quantity of the second medium has been chosen so that, in order to achieve an actuation of the barrel from a given elevated position towards the depressed position, an increase in pressure is required in the first medium, while, on the other hand, a reduction of the pressure in the first medium is required in order to actuate the barrel from the depressed position towards, for instance, the given elevated position. If gas is used as a second medium, it has proved to be appropriate to have a gas pressure of 40 bar at the ambient temperature when the barrel has an angle of elevation of +7° (= clamped position of the barrel). However, it can be appropriate to correct the gas pressure if the temperature, on the occasion when the gas is filled in, deviates substantially from the temperature at the time when firing takes place.

It is essential that satisfactory sealing be obtained between the two mediums utilized, i.e. that the sealing of the first piston part against the inner wall of the cylinder 6 is efficient, and accordingly the first piston part bears against the inner wall of the cylinder with three seals 25, 26 and 27, of which the seal 27 is of a special design, which is known in itself.

In order to achieve efficient sealing between the piston part in question and the inner wall of the cylinder, according to the present invention it is proposed that, for the purpose of lubrication, oil should be applied in a gap 28 between the seals 25 and 26, which application takes place according to a special procedure which will be described in the following.

In the example of the embodiment shown, approx 0.5 liters of hydraulic oil is to be filled into the space for the second medium when the barrel is in the depressed position, and the oil will then run down and lie over the second piston part 15. The barrel should thereafter be elevated to the maximum limit, which involves that oil will be pressed into the gaps between the insert unit 18 and the inner walls of the first piston part 7 and the first piston rod 8 and out into the gap 28 via the fastening hole in the ring 19 in the first piston part. The special seal 27 will thereby obtain lubrication, which guarantees good sealing between the space in question and a long life of the seals used.

Checking to ascertain that in each individual case a sufficient quantity of oil has been inserted in the gas space is achieved according to the invention by the second piston rod 16 having been made tubular, and that inside this piston rod there is an inner tube 29, which has one end connected with a filling and drain valve 30, and its other end emerging immediately above the second piston part 15. The inner tube is provided with external guide flanges. The inside 31 of the second piston rod 16 is connected with the gas space via a hole 32. Said valve 30 can be of a design which is known in itself, and therefore will not be described in detail.

When the oil level in the gas space is to be checked, the valve 30 is opened when the barrel, after having assumed the maximum elevated position, has been set in the depressed position. If then only gas flows out of the valve, i.e. the oil above the piston 15 does not reach up to the mouth of the inner tube 29, this indicates that more oil is to be filled in. If, on the other hand, only oil flows out of the opened valve 30, this is to be kept open until also gas flows out, which indicates that the proper quantity of oil has been inserted, and the valve can again be closed.

Figure 5:
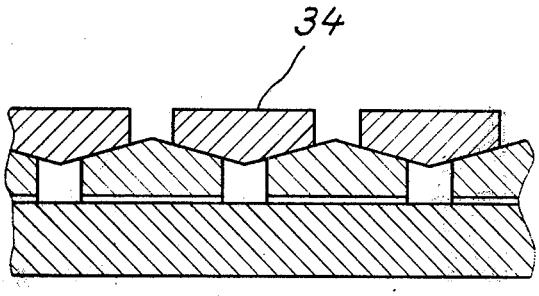

Also at said bearing housing 12, the cylinder is provided with a protruding flange 33. On the cylinder there is placed a ring spring 34, which is known in itself, which comprises elements with prismatic cross-sections which bear against each other via friction surfaces. The prismatic elements comprised in the ring spring are shown in FIG. 5. The ring spring is then set in between the protruding flange and the spherical bearing 13 so that it will dampen the cylinder when this executes axial movements in conjunction with the firing in the barrel. Said axial movements of the cylinder occur when the gun is fired, particularly at a high angle of elevation, when the barrel swings upwards from the neutral position in question. Such oscillations of the barrel of the gun are well known in this connection, and have hitherto had to be dampened with special spring arrangements (cup springs) in connection with the barrel. Technically seen, the solution of the problem obtained through the invention will be particularly attractive, and at the same time the efficiency of the damping will not be impaired.

In a practical example of the embodiment, it has proved to be appropriate to give said telescopically arranged parts a length of stroke of approx 800 mm, the cylinder 6 an internal diameter of approx 140 mm, the first piston rod 8 an outer diameter of approx 105 mm and an inner diameter of approx 90 mm, which gives a volume, in the depressed position, of the first space of approx 4.5 liters (exclusive of a volume of approx 0.5 liters for the oil for lubricating the seals). The further space for the hydraulic oil that executes the depression and elevation will have a volume of approx 0.5 liters in said depressed position.

The invention is not limited to the embodiment shown above as an example, but can be subject to modifications within the scope of the following claims.

We claim:

1. Power transmission apparatus for controlling the elevation of a gun barrel comprising:

first and second parts in telescopic relation with each other with said first part being secured to a base for the gun and with said second part being attached to the gun barrel, said first part including a first piston and a first piston rod secured to said first piston, said first piston being slidable in a first cylinder defined by said second part, a second piston having a second piston rod secured thereto, said second piston being slidable within a second cylinder defined by said first part and said second piston rod being attached to an end portion of said second part, a first chamber defined at least in part by the inner wall of said first cylinder and the outer wall of said first piston rod and filled with a low compressibility fluid.

a second chamber defined at least in part by the outer surface of said second piston rod and the inner wall of said first piston rod and filled with a high compressibility fluid said second piston rod being tubular and having a port communicating with said second chamber, an inner tube supported within said second piston rod, a filling and draining valve connected to one end of said inner tube and terminating a predetermined distance from said second piston, said second chamber communicating with a gap betwen the inner wall of said first cylinder and the outer wall of said first piston, and sealing means between the inner wall of said first cylinder and the outer wall of said first piston.

2. The apparatus of claim 1 which further includes insert means comprising inner and outer annular surfaces effective to provide double walls for said first piston and said first piston rod, and first piston defining an annular ledge to support said insert means, a securing ring restraining said insert means against movement away from said ledge, said second chamber communicating with said gap via the fastening hole of said securing ring.

3. The apparatus of claim 1 which further includes a flange secured to said second part, bearing means slidable on said second part and axially spaced from said flange, and helical spring means disposed about said second part between said flange and said bearing means for damping axial movement of said second part occurring in response to recoil forces.

* * * * *